United States Patent [19]

Takayama

[11] Patent Number: 4,957,082

[45] Date of Patent: Sep. 18, 1990

[54] VEHICLE CONTROL SYSTEM

[75] Inventor: Akira Takayama, Fukuroi, Japan

[73] Assignee: Yamaha Hatsudoki Kabushiki Kaisha, Iwata, Japan

[21] Appl. No.: 846,567

[22] Filed: Mar. 31, 1986

[51] Int. Cl.[5] ..... F02D 9/00; F02D 31/00

[52] U.S. Cl. ..... 123/334; 123/335; 123/363; 123/441

[58] Field of Search ..... 123/334, 335, 359, 395, 123/397, 400, 376; 180/170, 171, 172, 173, 174, 175, 176, 177, 178, 179

[56] References Cited

U.S. PATENT DOCUMENTS

| | | | |
|---|---|---|---|
| 1,798,388 | 3/1931 | Westcott | 123/441 |
| 2,724,376 | 11/1955 | Baumbecker | 123/441 |
| 2,732,834 | 1/1956 | Morgan | 123/335 |
| 2,831,472 | 4/1958 | Chantland | 123/441 |
| 4,181,103 | 1/1980 | Sturdy | 123/363 |
| 4,237,997 | 12/1980 | Swanson | 123/335 |
| 4,336,778 | 6/1982 | Howard | 123/334 |
| 4,436,076 | 3/1984 | Piteo | 123/334 |
| 4,512,303 | 4/1985 | Watanabe | 123/335 |
| 4,558,673 | 12/1985 | Mackie | 123/335 |

*Primary Examiner*—Raymond A. Nelli
*Attorney, Agent, or Firm*—Ernest A. Beutler

[57] ABSTRACT

A vehicle control system embodying an engine driving the vehicle and, selectively, a power takeoff shaft. When the power takeoff shaft is being driven, a governor controls the speed of the engine. A device is provided for detecting the shaft speed and the engine will be slowed when the shaft speed is exceeded to protect element being driven by the power takeoff shaft in the event the governor fails.

14 Claims, 3 Drawing Sheets

VEHICLE CONTROL SYSTEM

BACKGROUND OF THE INVENTION

This invention relates to a vehicle control system and more particularly to an arrangement for insuring against over speed of a power takeoff shaft driven by the vehicle engine.

Certain types of vehicles are provided with power takeoff shafts that are employed for driving external equipment such as lawnmowers, spreaders, cultivators or other types of devices. When using the power takeoff, it is a normal practice to provide a governor control for the engine speed so that the accessory will not be driven at a greater speed than its rated limit. However, mechanical governors, which are normally employed for this purpose, can at times fail and if the governor fails, there is a possibility that the accessory can be damaged due to being driven at a greater than its rated speed.

It is, therefore, a principal object of this invention to provide an improved vehicle control system.

It is another object of this invention to provide a safety backup for a governor control of engine speed.

It is a further object of this invention to provide a device for backing up a mechanical governor and insuring against over speed of a power takeoff shaft.

SUMMARY OF THE INVENTION

This invention is adapted to be embodied in a governor for an internal combustion engine having a shaft driven by the engine and a governor which is driven by the engine and which controls the engine speed. In accordance with the invention, means are provided for detecting the speed of the shaft and for retarding the speed of the engine if the detecting means senses an over speed condition.

DETAILED DESCRIPTION OF THE PREFERRED EMBODIMENT

Figure 2:
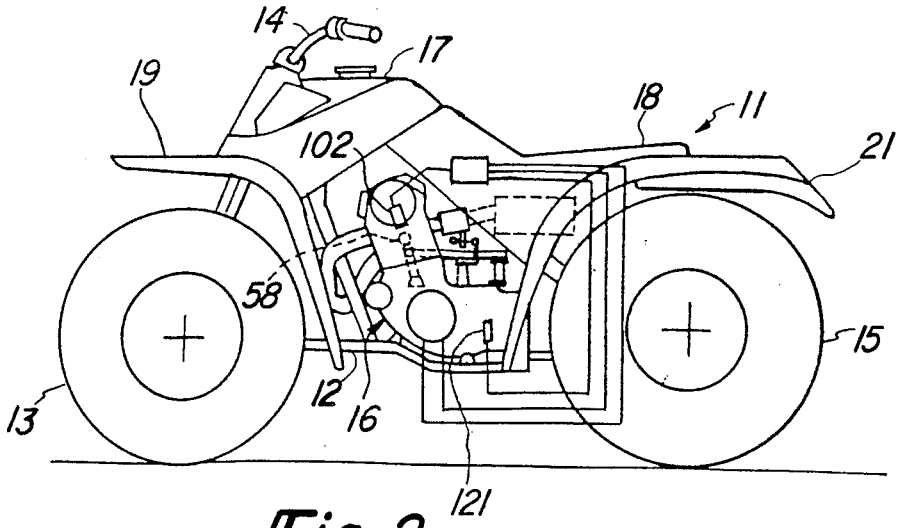
FIG. 2 is a side elevational view of a vehicle having an engine and power takeoff arrangement with a control device constructed in accordance with the embodiment.
Figure 3:
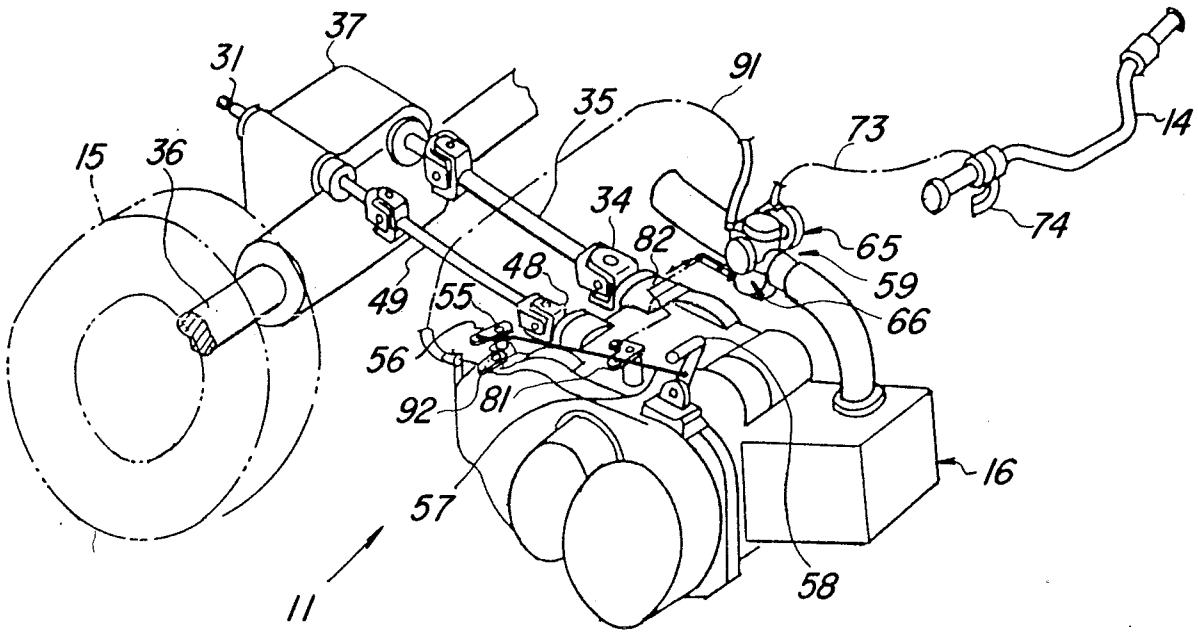
FIG. 3 is a partial perspective view, with portions shown in phantom and other portions removed, showing the vehicle.

Referring first to FIGS. 2 and 3, a vehicle constructed in accordance with a first embodiment of the invention is identified generally by the reference numeral 11. The vehicle 11 is of the type that is designed to be ridden by a single rider and is designed primarily for off the road use. Specifically, the vehicle 11 is adapted to be utilized for a wide variety of recreational or work purposes such as in the agricultural field for driving a lawnmower, water sprinkler or other known types of applications for such vehicles.

The vehicle 11 includes a frame assembly, indicated generally by the reference numeral 12, and which is depicted as being of the welded up type. Suspended at the front end of the frame 12 for steering and suspension movement are a pair of front wheels that mount low pressure balloon tires 13. The use of such low pressure balloon tires adapts the vehicle 11 particularly for off the road use. The term "low pressure balloon tires" is used to describe tires of the type that are normally inflated to a pressure in the range of 0.1 to 0.2 kg/cm$^2$. It is to be understood, however, that certain facets of the invention may be utilized in conjunction with vehicles of other types or, in fact, for other applications, as will become apparent.

The front wheels 13 are steered by means of a steering mechanism that includes a handlebar assembly 14 that is supported on the frame assembly 12 and which is coupled to the front wheels 13 for steering them in a known manner.

A pair of rear wheels 15, which also carry low pressure balloon tires, are carried at the rear end of the frame 12. The rear wheels 15 may be suspended, if desired, in any known manner, and are driven from a power plant assembly, indicated generally by the reference numeral 16, and which is supported within the frame assembly 12. The construction and operation of the power plant assembly 16 will be described hereinafter.

A fuel tank 17 is carried by the frame assembly 12 to the rear of the handlebar assembly 14 and above the power plant 16. Positioned rearwardly on the frame 12 from the fuel tank 17 is a saddle type seat 18 that is adapted to accommodate a single rider. A body comprised of a front fender assembly 19 which overlies the front wheels 13 and a rear fender assembly 21, which overlies the rear wheels 15, generally completes the major components of the vehicle 11.

Figure 4:
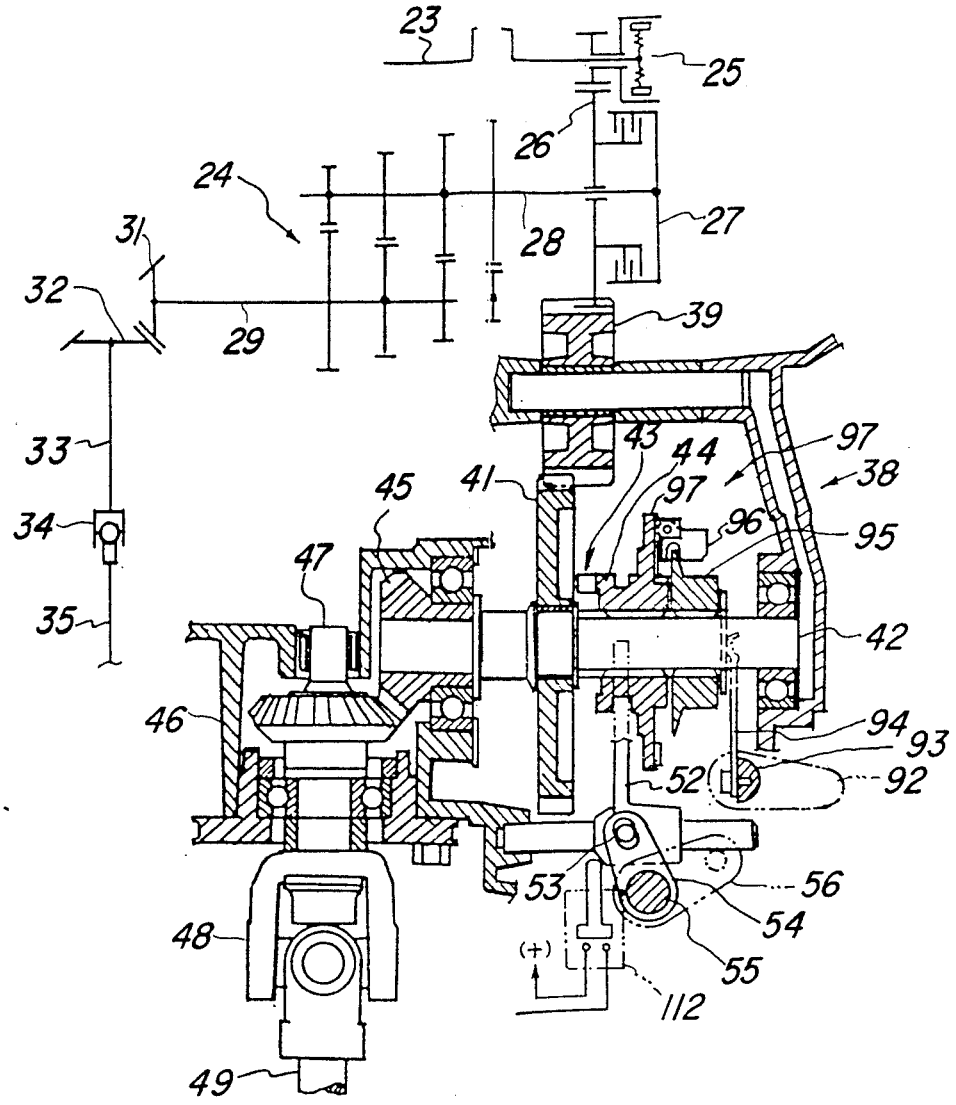
FIG. 4 is a partially schematic view showing the drive arrangement for the vehicle and the power takeoff shaft.

The construction of the power unit 16 and the mechanism for driving the rear wheels 15 will now be described by particular reference to FIG. 4. The power unit 16 includes an internal combustion engine, which in the illustrated embodiment, is depicted as of the single cylinder four-cycle type. It is to be understood, however, that the invention may be utilized in conjunction with engines of other types, as will become readily apparent to those skilled in the art. Since the invention is not concerned with the basic components of the engine other than its induction system, those conventional components are not shown.

The engine of the power plant 16 is supported within the frame 12 in such a manner that its output shaft 23 rotates about an axis that extends tranversely relative to the longitudinal center line of the vehicle 11. The output shaft 23, which is a crankshaft in the illustrated embodiment, is contained within a combined crankcase, transmission assembly in which a change speed transmission, indicated generally by the reference numeral 24, is positioned. A centrifugal clutch 25 is affixed to the output shaft 23 of the engine and drives a gear 26 when the speed of rotation of the crankshaft 23 exceeds a predetermined speed. A multi-disk clutch 27 selectively connects the gear 26 to a primary shaft 28 of the change speed transmission 24. There are a plurality of intermeshing gears carried by the primary shaft 28 and a secondary shaft 29 which are coupled to their respective shafts through selectively actuated dog clutches so as to select the speed ratio between the primary shaft 28 and the secondary shaft 29.

A bevel gear 31 is affixed to an outwardly extending end of the secondary shaft 29 and meshes with a bevel gear 32 that is fixed for rotation with an output shaft 33. The output shaft 33 is connected by means of a universal joint 34 to a longitudinally extending drive shaft 35 (FIG. 3). This drive shaft 35 drives a rear axle 36 via a final drive mechanism that is contained within a final drive casing 37.

Referring again to FIG. 4, the gear 26 also is employed for driving a power takeoff mechanism, indicated generally by the reference numeral 38, when the centrifugal clutch 25 is engaged. The power takeoff mechanism 38 includes an input gear 39 which is in mesh with and driven by the gear 26. The gear 39, in turn, drives a gear 41 that is journaled upon a shaft 42. The shaft 42 is adapted to be driven with the gear 41 when a dog clutch mechanism, indicated generally by the reference numeral 43, is engaged. The dog clutch mechanism 43 includes a dog clutch element 44 that is splined for rotation with the shaft 42 and which is axially movable along with it.

The shaft 42 has affixed to one of its ends a bevel gear 45 which, in turn, meshes with a bevel gear 46 that is fixed for rotation with a power takeoff output shaft 47. The power takeoff output shaft 47 has affixed to it a universal joint 48 which, in turn, drives a power takeoff shaft 49 (FIG. 3). The power takeoff shaft 49 is journaled within the final drive housing 37 and has an output end 51 that forms a coupling to which any known type of accessory, such as a lawnmower, sprinkler or the like may be attached in a known manner.

Referring again to FIG. 4, the dog clutch 43 includes a shifting fork 52 received within a groove in the dog clutching element 44. The shifting fork 52 has a lug 53 that is received within a recess formed in a shifting lever 54. The shifting lever 54 is, in turn, affixed to a shaft 55 which is journaled within the transmission housing in an appropriate manner. Affixed to an extending end of the shaft 55 is a lever 56. The lever 56 has pivotally connected to it one end of a link 57 (FIG. 3). The other end of the link 57 is pivotally connected to a changeover or power takeoff lever 58 that is positioned on the vehicle adjacent to one side of the power unit 16. As seen in the figures, the power takeoff dog clutch 43 is normally not engaged when the power takeoff lever 58 is in a rearward position. When the operator pushes the lever 58 forwardly, a force will be exerted through the link 57 that rotates the lever 56 and effects sliding movement of the shifting fork 52 to the left as seen in FIG. 4 so that the dog clutch 43 is engaged and the power takeoff shaft 49 will be driven when the speed at which the centrifugal clutch 25 is engaged is exceeded.

The engine of the power unit 16 includes an induction system in which a charge forming device 59 is provided. The charge forming device 59 is in the form of a carburetor and includes a throttle valve (not shown) which controls the engine speed. The throttle valve is adapted to be actuated manually by a rider by means of a manual throttle valve actuating mechanism, indicated generally by the reference numeral 65 and which includes a wire transmitter 73 that is connected at one of its ends to the manual throttle actuator 65 and at its other end to a control lever 74 that is carried by the handlebar assembly 14 for manual engine speed control.

The carburetor 59 is also provided with a governor throttle valve control, indicated generally by the reference numeral 66. A mechanism is provided for selecting either manual throttle control by the device 65 or automatic throttle control by the governor device 66 in response to shifting of the changeover lever 58 from a non-power takeoff to a power takeoff mode. This mechanism includes a bellcrank 81 that is pivotally supported upon the engine casting and which has one of its arms pivotally connected to the link 57 intermediate the ends of the link. Another arm of the bellcrank 81 is connected by means of a link 82 to a mechanism for selecting either governor throttle control or manual throttle control. This mechanism is of the type shown and described in a copending Application in the names of Minoru Fujita and Hirotaka Shibata, entitled "Control Device For Vehicle" and assigned to the assignee of this application (Attorney Docket No. 2503-F1104). The specific mechanism for achieving this purpose is not relevant to the invention of this application and reference may be had to the copending application for the details of its construction.

The governor throttle control 66 is connected by means of a flexible transmitter 91 to a governor control lever 92. The governor control lever 92 is affixed to a shaft 93 (FIG. 4) which is journaled in the transmission assembly. A fork 94 is connected to the shaft 93 and extends into the transmission and is engaged with one side of a bushing 95 of a governor assembly, indicated generally by the reference numeral 96. The bushing 95 is slidably supported on the shaft 42 and has a peripheral flange that is engaged within a plurality of centrifugal weights 96 that are supported on an annular flange 97 of a member that is affixed for rotation with the dog clutching element 44.

The embodiment as thus far described works as follows. The rear wheels 15 are powered through the change speed transmission 24 when the multiple disk clutch 27 is engaged and when the speed of rotation of the engine crankshaft 23 is sufficient to effect engagement of the centrifugal clutch 25. It is believed that this mechanism is well known to those skilled in the art and, therefore, a more detailed description of its construction and operation is not believed to be necessary. It should be noted, however, that when the power takeoff shaft 49 is not being driven, the change over lever 58 will be in such a position that the carburetor throttle valve control will be under the operator manual lever 74 through the manual throttle valve actuator mechanism 65.

If the arrangement is shifted into the power takeoff mode, the accessory is connected to the power takeoff shaft adapter 51 in a known manner. The operator then moves the power takeoff lever 58 forwardly so as to exert a force through the link 57 on the lever 56. This will cause the shifting fork 52 to be slid along the shaft 42 so as to engage the dog clutch 43. At the same time, the link 82 will be pulled so that the throttle valve of the carburetor 59 is now under governor control through the mechanism 66.

When the shaft 42 is not rotating, the centrifugal weights 96 will be moved radially inwardly so that the collar 95 will be slid and followed by the fork 94 so that the control wire 91 will be tensioned to fully open the carburetor throttle valve. As the speed of the shaft 42 and, accordingly, the power takeoff shaft 49 increases, the centrifugal weights 96 will pivot outwardly so as to move the collar 95 to the right as shown in FIG. 4. This will pivot the fork 94 and shaft 93 so as to pivot the lever 92 and cause the carburetor throttle valve to become closed until the speed of the shaft 42 reaches the governed speed and it will be maintained at that speed. Therefore, the speed of the power unit 16 will be regulated so that the speed of the power takeoff shaft is maintained constant at the predetermined and required speed. In this way, it will be insured that the speed of the accessory driven by the power takeoff shaft will not exceed its rated speed.

There always exists the possibility that the mechanical governor mechanism 96 may fail. If this occurs, and there is the possibility that the speed of the power unit 16 may become excessive and the speed of the accessory driven by the power takeoff shaft 49 may exceed its rated speed. A mechanism as best shown in FIG. 1 is provided to insure against this likelihood.

Figure 1:
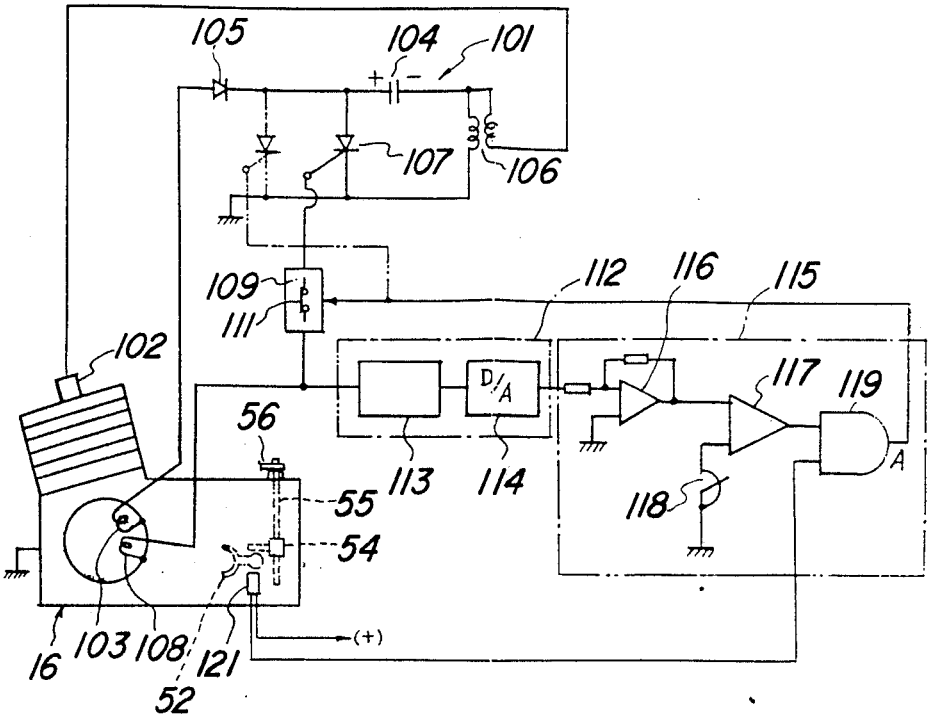
FIG. 1 is a partially schematic view showing the control circuit constructed in accordance with an embodiment of the invention.

Referring now specifically to FIG. 1, the power unit 16 and specifically its engine is provided with a capacitor discharge ignition system, indicated generally by the reference numeral 101 for firing the spark plug 102. This ignition system includes a charging coil 103 which is juxtaposed to a rotating magnet carried by the crankshaft 23 and which charges a capacitor 104 through a circuit including a diode 105 to a polarity as indicated in FIG. 1. The charging capacitor 104 is in circuit with a primary winding 106 of an ignition coil. The secondary winding of the ignition coil 106 is in circuit with the spark plug 102.

The discharge of the capacitor 104 to fire the spark plug 102 is controlled by means of a thyristor 107 that has its gate connected to a trigger coil 108 by means including a switch 109 having a normally closed contact 111. As is known in this art, the capacitor 104 is charged by the charging coil 103 and when saturated, it is discharged by making the gate of the thyristor 107 conductive. At this time, a current will be induced in the primary winding of the coil 106 and amplified by the secondary winding for firing the spark plug 102, as is well known in this art.

An over speed detector mechanism is provided for opening the normally closed contacts 111 so as to interrupt the ignition of the engine of the power unit 116 if a preset speed is exceeded. This arrangement includes a speed detector 112 that is comprised of a wave form shaper circuit 113 that receives an output from the pulser coil 108 so as to indicate engine speed. The wave shaper circuit 113 transmits its output to a converter 114 that outputs a voltage that is indicative of engine speed. This voltage is transmitted to a discriminator circuit 115 and specifically to an amplifier 116 of that circuit. The amplifier 116 outputs its voltage to a comparator 117. The comparator 117 compares the voltage signal, which is indicative of speed, with a preset voltage (speed) signal set by a rheostat 118 and provides an output to an AND circuit 119 when the speed of the engine exceeds the preset speed set by the resistor 118.

However, the AND circuit 119 does not provide this disabling output unless the power takeoff dog clutch 43 is engaged. This condition is sensed by a detector switch 121 that is position so as to be contacted and closed when the dog clutch 43 is engaged. The detector switch 112 is engaged by the shift fork 52 of the dog clutch.

When the AND circuit senses both an over speed condition and driving of the power takeoff shaft, it will output a signal which opens the switch contact 111 and causes misfiring of the spark plug. Then, the engine speed will decrease.

Rather than disabling the firing of the spark plug 112, the engine speed may be reduced by changing the spark advance. This can be done if the gate of thyristor 107 is in circuit with the output of the AND circuit 119 as shown in the phantom line view of FIG. 1. Alternatively, other arrangements may be employed for stopping the engine or for reducing its speed.

It should be readily apparent from the foregoing description that the device is extremely adapt at protecting the driven accessory from over speed even in the event the governor fails. Although an embodiment of the invention has been illustrated and described, various changes and modifications may be made without departing from the spirit and scope of the invention, as defined by the appended claims.

I claim:

1. In a governor for an internal combustion engine having a shaft driven by said engine, and governor means driven by said engine for controlling the speed of said engine by operation of a first control system of said engine, the improvement comprising means for detecting the speed of said shaft and means for retarding the speed of said engine through operation of a second control system of said engine if said detecting means senses an over speed condition.

2. In a governor as set forth in claim 1 wherein the first control system comprises a throttle of the engine induction system.

3. In a governor as set forth in claim 2 wherein the second control system is the engine ignition circuit.

4. In a governor as set forth in claim 3 wherein the ignition circuit is controlled by interrupting the firing of the spark plug.

5. In a governor as set forth in claim 1 in combination with a vehicle driven by the engine.

6. In a governor as set forth in claim 5 wherein the shaft comprises a power takeoff shaft.

7. In a governor as set forth in claim 6 wherein the means for retarding the speed of the engine is operative only when the power takeoff shaft is being driven.

8. In a governor as set forth in claim 7 wherein the first control system comprises a throttle in the engine induction system.

9. In a governor as set forth in claim 8 wherein the second control system is the engine ignition circuit.

10. In a governor as set forth in claim 9 wherein the ignition circuit is controlled by interrupting the firing of the spark plug.

11. In a governor as set forth in claim 7 wherein the governor means is driven by the power takeoff shaft and further including clutch means between the engine and said power takeoff shaft for selectively disconnecting the driving relationship between said engine and said power takeoff shaft and said governor means.

12. In a governor as set forth in claim 11 wherein the means for retarding the speed of the engine only when the power takeoff shaft is being driven includes an and circuit responsive to the condition of the clutch for driving the power takeoff shaft and the engine speed.

13. In a governor as set forth in claim 12 wherein the speed of the engine is retarded by the detector means by controlling the engine ignition circuit.

14. In a governor as set forth in claim 13 wherein the ignition circuit is controlled by interrupting the firing of the spark plug.

* * * * *